US006125857A

United States Patent [19]

Silber

[11] Patent Number: 6,125,857

[45] Date of Patent: Oct. 3, 2000

[54] DUAL SIDEBURN TRIMMER

[76] Inventor: David Silber, 45 Tropical St., Guaynabo, Puerto Rico 00969

[21] Appl. No.: 09/324,864

[22] Filed: Jun. 3, 1999

Related U.S. Application Data

[60] Provisional application No. 60/092,559, Jul. 13, 1998.

[51] Int. Cl.[7] ..... A45D 2/50; A45D 27/22; B26B 21/00; B26B 19/06

[52] U.S. Cl. ..... 132/215; 132/289; 30/50; 30/34.1

[58] Field of Search ..... 132/215, 289; 33/369, 379, 389; 30/50, 34.1

[56] References Cited

U.S. PATENT DOCUMENTS

| | | | |
|---|---|---|---|
| 4,010,764 | 3/1977 | Wagner | 132/215 |
| 4,106,515 | 8/1978 | Miller | 132/215 |
| 4,292,741 | 10/1981 | Scandella | 33/379 |
| 4,501,066 | 2/1985 | Sceberras | 30/50 |
| 4,989,328 | 2/1991 | Sokoloff | 30/34.1 |
| 5,450,671 | 9/1995 | Harshman | 30/31 |
| 5,542,178 | 8/1996 | Harkleroad | 30/34.1 |
| 5,568,688 | 10/1996 | Andrews | 30/29.5 |
| 5,636,442 | 6/1997 | Wain | 30/40.2 |
| 5,820,476 | 10/1998 | Amato | 473/217 |

FOREIGN PATENT DOCUMENTS

| | | |
|---|---|---|
| 305866 | 3/1989 | European Pat. Off. . |
| 305883 | 3/1989 | European Pat. Off. . |

*Primary Examiner*—John J. Wilson
*Assistant Examiner*—Robyn Kieu Doan
*Attorney, Agent, or Firm*—Richard C. Litman

[57] ABSTRACT

A dual sideburn trimmer provides for the simultaneous, accurate, level cutting or trimming of the opposite sideburns of a person using the present trimmer. The trimmer includes a generally U-shaped handle portion, with the handle portion including two parallel, straight arms for holding, cutting or trimming elements at their distal ends, and a straight crossmember joining the two trimming element arms at their ends opposite the cutting elements. The junctures between the crossmember and the two trimming element arms may be smoothly curved. The center of the crossmember includes a level installed thereon or therein, with the level preferably comprising a spirit type level partially filled with a liquid (e.g., water). A sight line is provided along the level vial, with which the liquid level within the level vial may be aligned to assure that the crossmember, and thus the two trimming element arms, are level with one another to provide a precisely even trim. The liquid within the level vial may be colored, to provide improved contrast and better visibility. The trimming element attachment ends of the two trim element holding arms are preferably configured to hold removably installed trimming elements therein. The trimming elements may be conventional disposable razor cartridges, injector blades, etc., as desired. Alternatively, the present trimming device may be constructed to hold relatively permanent cutting elements, if so desired. The device is adjustable for different users, with lateral width adjustment being provided by the handle portion of the device.

19 Claims, 5 Drawing Sheets

DUAL SIDEBURN TRIMMER

REFERENCE TO RELATED PATENT APPLICATION

This application claims the benefit of U.S. Provisional Patent Application Ser. No. 60/092,559, filed on Jul. 13, 1998.

BACKGROUND OF THE INVENTION

1. Field of the Invention

The present invention relates generally to devices and apparatus for personal grooming, and more specifically to a device adapted for personal use, for simultaneously and evenly trimming the sideburns.

2. Description of Related Art

The art of good personal grooming has become increasingly important in the modern world for most people, in both professional and social environments. Historically, the lack of technology for producing razor blades for personal shaving and grooming, resulted in most men electing to wear beards during their adult lives, or perhaps visiting a barber on a weekly basis for a professional shave. Even so, much of the face was often covered by a beard and/or mustache, with any trimming required being performed professionally by the barber.

The development of safety razors and the like for personal use, has resulted in the vast majority of men electing to adopt a clean shaven appearance and shaving daily. While some facial hair is still worn by many men, most men have adopted styles with relatively short sideburns, with their length ending at about the level of the midpoint of the ear.

It will be noted that with such clean shaven styles, that any discrepancy in the cutting or trimming of a beard or hair is more readily noticed. Yet, current fashion leans toward such a clean cut and well trimmed look. It can be difficult for a person to maintain such a sharp appearance relative to certain areas of the hair, such as the length of the sideburns, due to the need to trim each of the sideburns independently. This can result in a person alternatingly trimming first one sideburn, then noting that the second sideburn is slightly longer and trimming that sideburn inadvertently to a shorter length than the first, thus having to retrim the first, etc. While such innovations as three way mirrors and other grooming aids have provided considerable assistance with such grooming problems, these aids do nothing to actually perform the precisely even cutting or trimming of sideburns which is desirable for many tonsorial styles in the contemporary professional and social environments.

Accordingly, a need will be seen for a personal grooming device which may be used by a person for simultaneously and evenly trimming both sideburns of the user. The device must provide for economy, ease of use, and precision in performing the grooming task.

A discussion of the related art of which the present inventor is aware, a nd its differences and distinctions from the present invention, is provided below.

U.S. Pat. No. 4,010,764 issued on Mar. 8, 1977 to Stan Wagner, titled "Sideburn Trimming Guide," describes a device for positioning a cut or trim to be made to the sideburns. The device comprises a band which fits over the top of the head, generally from one temple to the other. Additional guides are provided for fitting over each ear, for more precisely positioning each sideburn guide. Wagner also includes lighting means for illuminating the guide scale on each side. However, Wagner does not provide any means to actually cut or trim the sideburns of the user of the device. Rather, the user must use a separate razor to perform the trimming operation. In contrast, the present device serves not only as a guide, but also as a cutting and trimming implement as well. Moreover, the present dual sideburn trimmer invention does not contact the head except where the razor elements contact the sideburns. The present invention also utilizes spirit level means for leveling the device, which means is not disclosed by Wagner.

U.S. Pat. No. 4,106,515 issued on Aug. 15, 1978 to David Miller, titled "Side Burn Trimming Guide," describes a device similar to the Wagner device discussed immediately above. As in the case of the Wagner device, the Miller device fits over the top of the head (as well as around the head), and provides only guides or templates for cutting or trimming. No actual cutting elements are provided by Miller, nor is any leveling means disclosed.

U.S. Pat. No. 4,501,066, issued on Feb. 26, 1985 to Conrad T. Sceberras, titled "Dual Headed Razor System," describes a device having a single handle with two curved but generally parallel arms extending therefrom. Each of the arms includes a double bladed safety razor head removably secured to the distal end thereof, with the cutting angles of the blades of each head, facing one another. Thus, the Sceberras razor provides a shaving action when moved in a direction toward either of the razor heads. Sceberras does not address the problem of simultaneously evenly cutting or trimming sideburns, as his razor system cannot be used simultaneously on both sides of the head, as provided by the present sideburn trimming apparatus. Moreover, Sceberras does not provide any leveling means with his razor, as is provided in the present sideburn trimming apparatus.

U.S. Pat. No. 4,989,328 issued on Feb. 5, 1991 to Daniel Sokoloff, titled "Dual Headed Razor Assembly," describes various embodiments of an assembly including a conventional safety razor head and a smaller, i. e., narrower, safety razor head either permanently or removably secured to a single handle. As in the Sceberras apparatus discussed immediately above, Sokoloff does not provide for two separate razors disposed upon a single structure for positioning to each side of the head, nor does he provide any form of leveling means for such an assembly, which features are a part of the present dual sideburn trimmer invention.

U.S. Pat. No. 5,450,671 issued on Sep. 19, 1995 to David Harshman, titled "Hair Trimming Device," describes an article for use in trimming and thinning hair, particularly female pubic hair. No means of simultaneously positioning opposed trimming blades to opposite sides of the head, nor leveling the blades precisely, is disclosed by Harshman.

U.S. Pat. No. 5,542,178 issued on Aug. 6, 1996 to Zeke S. Harkleroad, titled "Razor For Shaving Curved Areas Of The Body," describes an apparatus having a general configuration much like a conventional safety razor, but including a much smaller arcuately shaped blade adjustably positioned in the head of the handle, opposite the more conventional razor head. The smaller curved blade is adapted for trimming tightly curved areas of the face, such as the philtrum, or vertical depression in the upper lip below the nose. The arcuately curved blade is not adapted for making a straight cut or trim as required for trimming the sideburns, and in any event cannot be separated from the more conventional blade for simultaneous shaving or trimming use, as provided by the present dual sideburn trimming invention.

U.S. Pat. No. 5,568,688 issued on Oct. 29, 1996 to Edward A. Andrews, titled "Hair Shaving Device With Curved Razor Blade Strip," describes a device having a narrow blade bent to form a generally U-shaped configuration, with one or more guards disposed to the outer and/or inner surfaces thereof. The two ends of the U-shaped blade are secured to a single handle end. The device is adapted for trimming hair in relatively small bodily orifices, i. e., the nostrils and ear canals. The device includes only a single blade, although the blade is bent to form two opposed cutting surfaces. The Andrews razor apparatus cannot be separated to provide two widely spaced blades for simultaneously trimming the sideburns on opposite sides of the head, as provided by the present dual sideburn trimming device.

U.S. Pat. No. 5,636,442 issued on Jun. 10, 1997 to Kevin J. Wain, titled "Shaving Systems With Blade Holder," describes a razor handle and head system in which the razor head comprises a cartridge which is removably installable on the end of the handle. A plurality of cartridges are provided in a case, with a used cartridge installed on the handle being inserted into an empty slot in the case, the handle being drawn toward the next available cartridge in sequence to release the used cartridge and pick up the new cartridge, and then being withdrawn from the case with the new cartridge attached. The Wain system can pick up only a single cartridge on the handle at any one time, and thus the handle cannot accommodate two widely separated blades at a time for simultaneously trimming the sideburns on opposite sides of the head, as provided by the present invention.

European Pat. Publication No. 305,866 published on Mar. 8, 1989 to the Gillette Company, titled "Shaving Device," describes an elastomeric pad (e. g., a sponge-like material) having a series of toroidally shaped blades mounted in one surface thereof. Each of the blades includes a cutting edge formed about its inner edge. The resilience of the pad enables the device to be drawn over virtually any area of the body, and to conform closely to the shape of the body surface at that area while the plurality of small cutting blades trim the hair from the area. As the Gillette device disposes the razor blades throughout a single sponge-like carrier, the device is not adapted to position only two widely spaced straight edged blades to opposite sides of the head for simultaneous trimming of the sideburns, as provided by the present invention.

Finally, European Pat. Publication No. 305,883 published on Mar. 8, 1989 to the Gillette Company, titled "Shaving Device," describes in detail the structure and configuration of the blades used in the device of the '866 European Pat. Publication discussed immediately above. A handled holder for such toroidally shaped blade elements is also disclosed, as well as various geometric arrangements and configurations of blade groups using such blades. The same points as raised in the discussion of the '866 European Pat. Publication discussed immediately above, are seen to be relevant here.

Although many devices have been developed previously for addressing the different problems associated with shaving, as indicated by the discussion above, it is still necessary to have an instrument that allows for the simultaneous and even trimming of sideburns. None of the above inventions and patents, taken either singly or in combination, is seen to describe the instant invention as claimed.

SUMMARY OF THE INVENTION

The present invention comprises a dual sideburn trimmer, for accurately, evenly, and simultaneously trimming both sideburns on opposite sides of the head, thereby precluding any unsightly appearance due to the sideburns being uneven. The device includes a generally U-shaped handle portion, with the handle portion including two parallel, straight arms for holding cutting or trimming elements at their distal ends, and a straight crossmember joining the two trimming element arms at their ends opposite the cutting elements. The junctures between the crossmember and the two trimming element arms may be smoothly curved.

The center of the crossmember includes leveling means installed thereon or therein, with the leveling means preferably comprising a spirit type level partially filled with a liquid (e.g., water). A sight line is provided along the level, with which the liquid level within the level container may be aligned to assure that the crossmember, and thus the two trimming element arms, are level with one another to provide a precisely even trim. The liquid within the glass or container may be colored, to provide improved contrast and better visibility.

The trimming element attachment ends of the two trim element holding arms are preferably configured to hold removably installed trimming elements therein. The trimming blades may be conventional disposable razor cartridges, injector blades, etc., as desired. Alternatively, the present trimming device may be constructed to hold relatively permanent cutting elements, if so desired.

The handle or frame portion is preferably formed of a somewhat flexible material, at least insofar as the span of the two arms is concerned, in order to fit various sizes of heads. Plastics and some metals are suitable materials for the handle or frame portion of the present invention. Stiffness in a direction away from the plane of the handle, may be provided by making this dimension of the handle portion relatively greater than the dimension through the plane of the handle, or of correspondingly stiffer materials, etc. Alternatively, one or both arms may telescope relative to the central crossmember, for adjustment of the width of the device.

Accordingly, it is a principal object of the invention to provide a dual sideburn trimming device for simultaneously trimming both sideburns of a user of the device.

It is another object of the invention to provide a sideburn trimmer for trimming both sideburns evenly at the same level.

It is a further object of the invention to provide a sideburn trimming device including means for indicating a level cutting orientation.

Yet another object of the invention is to provide a sideburn trimming device which level indicating means comprises a spirit level disposed along the central lateral crossmember of the device.

Still another object of the invention is to provide a sideburn trimmer which cutting or trimming elements may be disposable.

An additional object of the invention is to provide a sideburn trimmer including means for adjusting to the width of the head of a user of the device.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
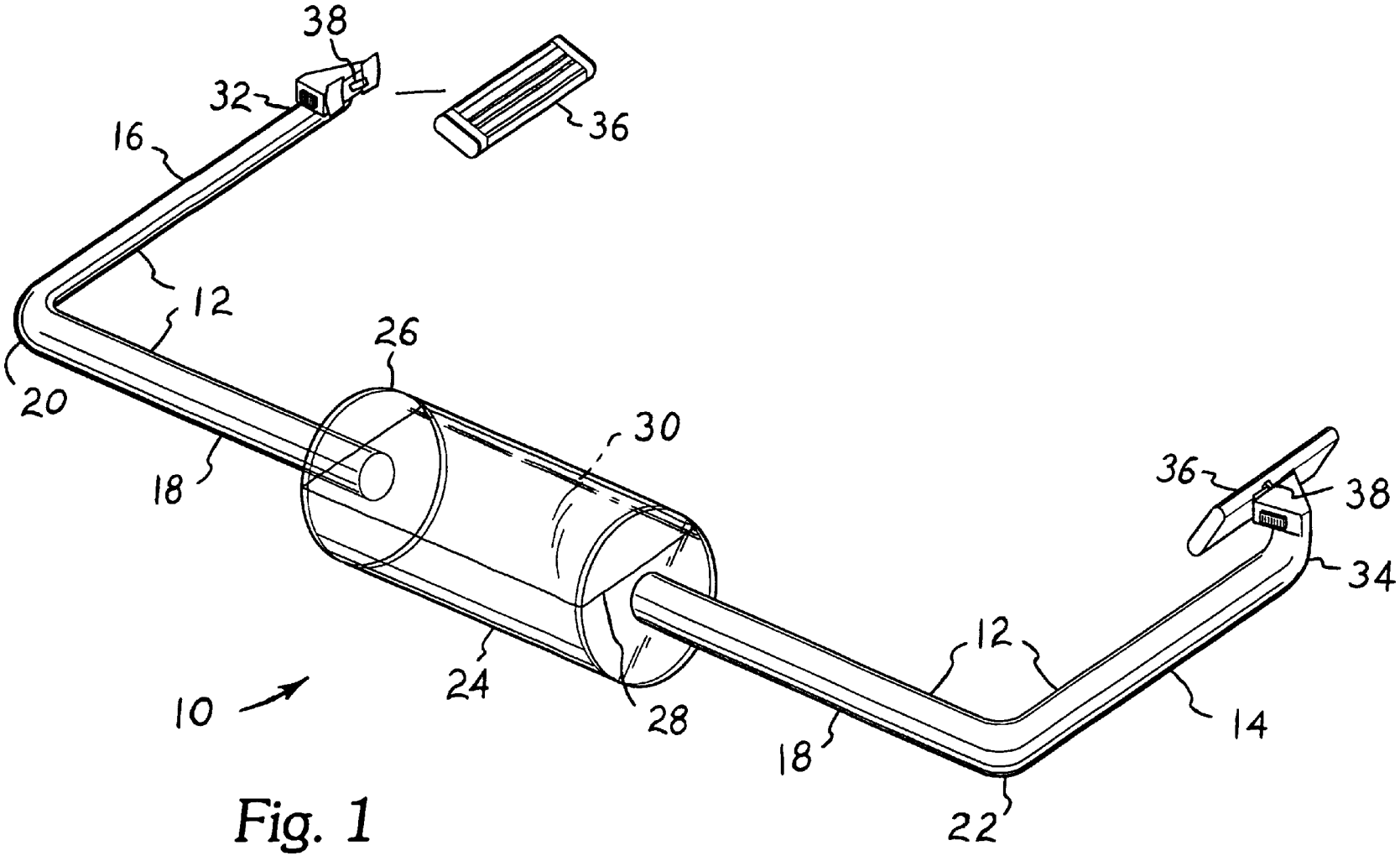
FIG. 1 is a perspective view of a dual sideburn trimmer according to the present invention, showing its general features.

The present invention comprises a dual sideburn trimming device, serving to provide for the simultaneous and precisely even cutting or trimming of both sideburns of a person using the device. FIG. 1 illustrates a perspective view of a first embodiment of the present sideburn trimmer, designated by the reference numeral 10. The sideburn trimmer 10 includes a handle 12 having two parallel, opposed arms, respectively 14 and 16. A crossmember 18 joins the two arms 14 and 16 at their crossmember attachment ends, respectively 20 and 22. The crossmember attachment ends or junctures 20 and 22 with the crossmember 18 may be smoothly curved; alternatively, the entire crossmember portion 18 may be smoothly curved between the two opposed arms 14 and 16, if so desired.

A leveling device 24 is positioned generally centrally along the crossmember 18. The level 24 may be installed generally concentrically between opposite portions of the crossmember 18, or may be secured along the unbroken length of the crossmember 18. The leveling device 24 may comprise any of various types of such devices (pendulum, etc.), but is preferably a spirit or bubble level type device, comprising a level vial 26 having a liquid 28 (e. g., water, or other suitable liquid as desired) disposed therein and partially filling the vial 26 to provide a constantly level liquid to gas interface therein. The liquid 28 is preferably colored or tinted for better visibility thereof. A level line 30 is preferably provided along one side of the vial, e. g., the rearward side positioned toward the user when the device is in use.

The two arms 14 and 16 each include a trimming element attachment end, respectively 32 and 34, opposite their respective crossmember attachment ends 20 and 22. A sideburn trimming element (razor blade, etc.) 36 extends inwardly from each of the attachment ends 20 and 22 of the two arms 14 and 16. The sideburn trimming elements 36 each include some form of sharp blade, with the blades of the two elements 36 being parallel to one another and preferably parallel to the plane defined by the handle portion 12 of the present trimming device 10. The trimming elements 36 may comprise any of a number of various cutting or trimming devices, such as the conventional disposable razor cartridges shown in the drawing Figures, which are removably secured to their respective trim element attachment ends 32 and 34 by conventional mating latch means 38 as found in various other razor devices having disposable cutting elements removably secured to a handle. Other sideburn cutting or trimming means, e. g., conventional single or double edge razor blades removably secured in appropriate heads, injector blades, etc., may be provided with the present sideburn trimming device 10, as desired.

Figure 3:
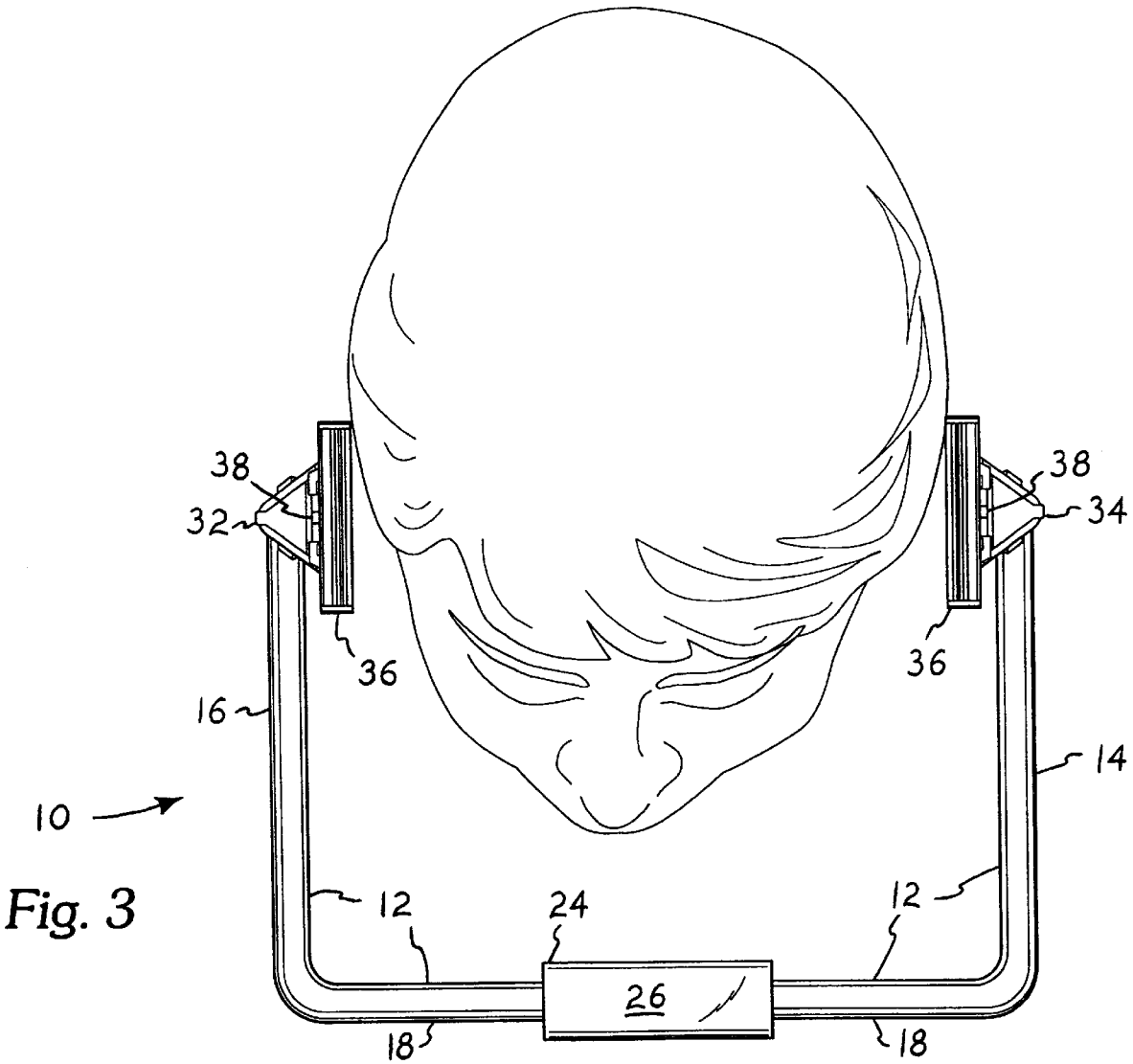
FIG. 3 is an environmental top plan view of the dual sideburn trimmer according to the present invention, showing its operation and use.

The present dual sideburn trimmer 10 is used generally as shown in FIG. 3 of the drawings. The handle portion 12 is positioned with the first and second arms 14 and 16 positioned on opposite sides of the head, and with the crossmember 18 positioned in front of the user's face where the sight glass or vial 26 for the leveling means 24 is readily visible. The user then need only level the device 10 by raising or lowering one or the other of the arms 14 and 16 to align the level line 30 with the level of the liquid 28 within the level vial 26, to assure that the two opposed cutting elements 36 are level with one another, to provide a precisely even trim of the sideburns of the user.

Figure 2A:
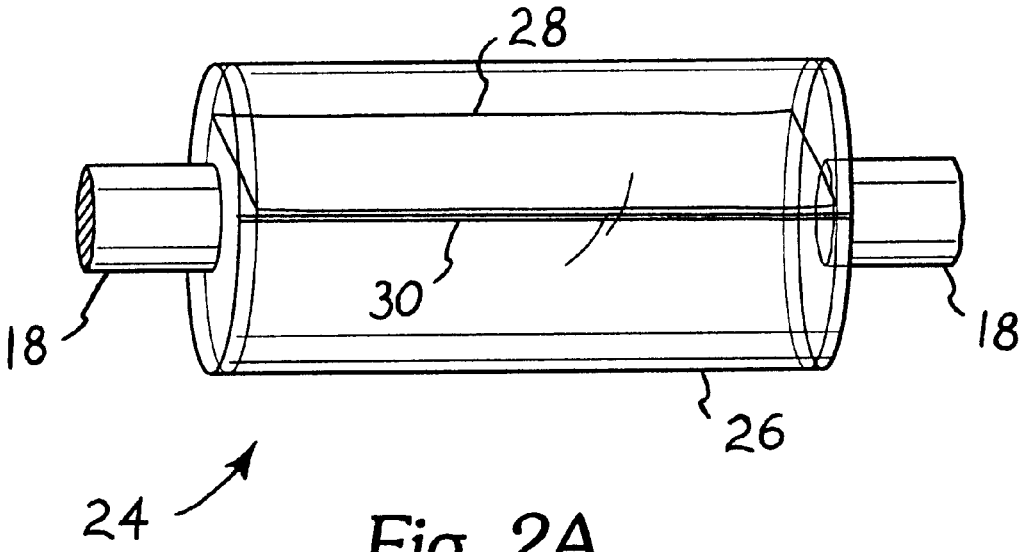
FIG. 2A is a broken away rear perspective view of the center portion of the crossmember of the device showing details of the leveling instrument, with the instrument indicating a level cutting position.
Figure 2B:
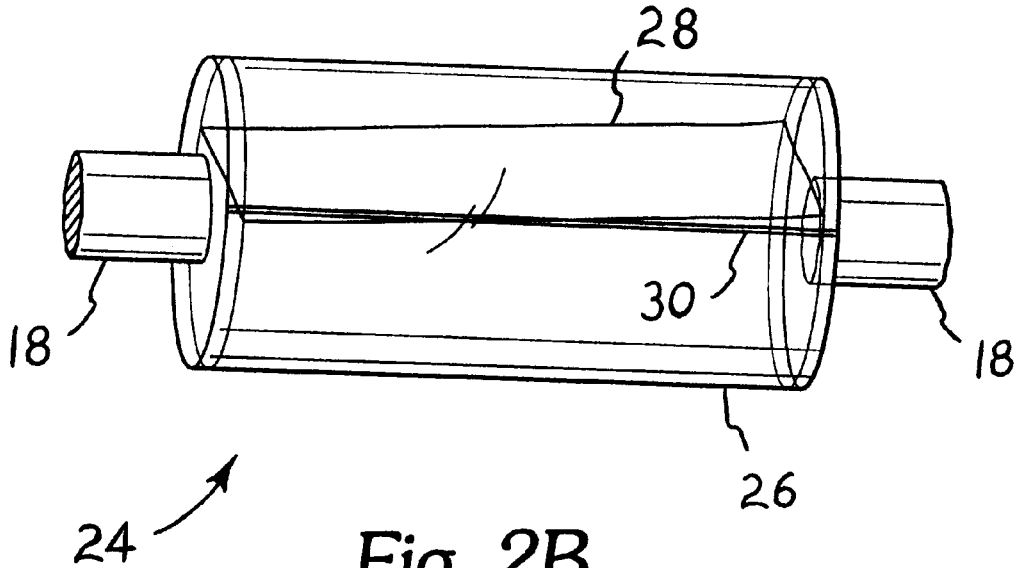
FIG. 2B is a broken away rear perspective view of the leveling instrument of FIG. 2A, with the instrument indicating a lateral slope which would result in an uneven sideburn trim.

FIGS. 2A and 2B provide views from the point of view of a user of the device 10, of the appearance of the level vial 26 and fluid 28 encapsulated therein, when the device 10 and level 24 are precisely level (FIG. 2A) and when the device 10 is tilted slightly downwardly to the right (FIG. 2B). In the case of the tilt of FIG. 2B, the user of the device need only raise the right arm 16 very slightly until achieving the appearance of the level 24 of FIG. 2A with the fluid level and level line 30 being aligned with one another, and trimming the sideburns at that point.

Different users of the present dual sideburn trimming device 10 may have heads of different sizes, with the distance between the temples varying between different individuals. Accordingly, the present device 10 provides for at least some lateral adjustment of the width or distance between the two cutting elements 36 disposed at the opposite trimming element attachment ends 32 and 34 of the two arms 14 and 16. By constructing the handle portion 12 comprising the two arms 14 and 16 and the central crossmember 18 of flexible materials (e. g., relatively spring steel wire or leaf material, various flexible plastics, etc.) the two arms 14 and 16 of the device 10 may be bowed slightly inwardly or outwardly, and/or the crossmember may be flexed, to provide a good fit of the two cutting or trimming elements 36 to each temple of the user's head.

Figure 4:
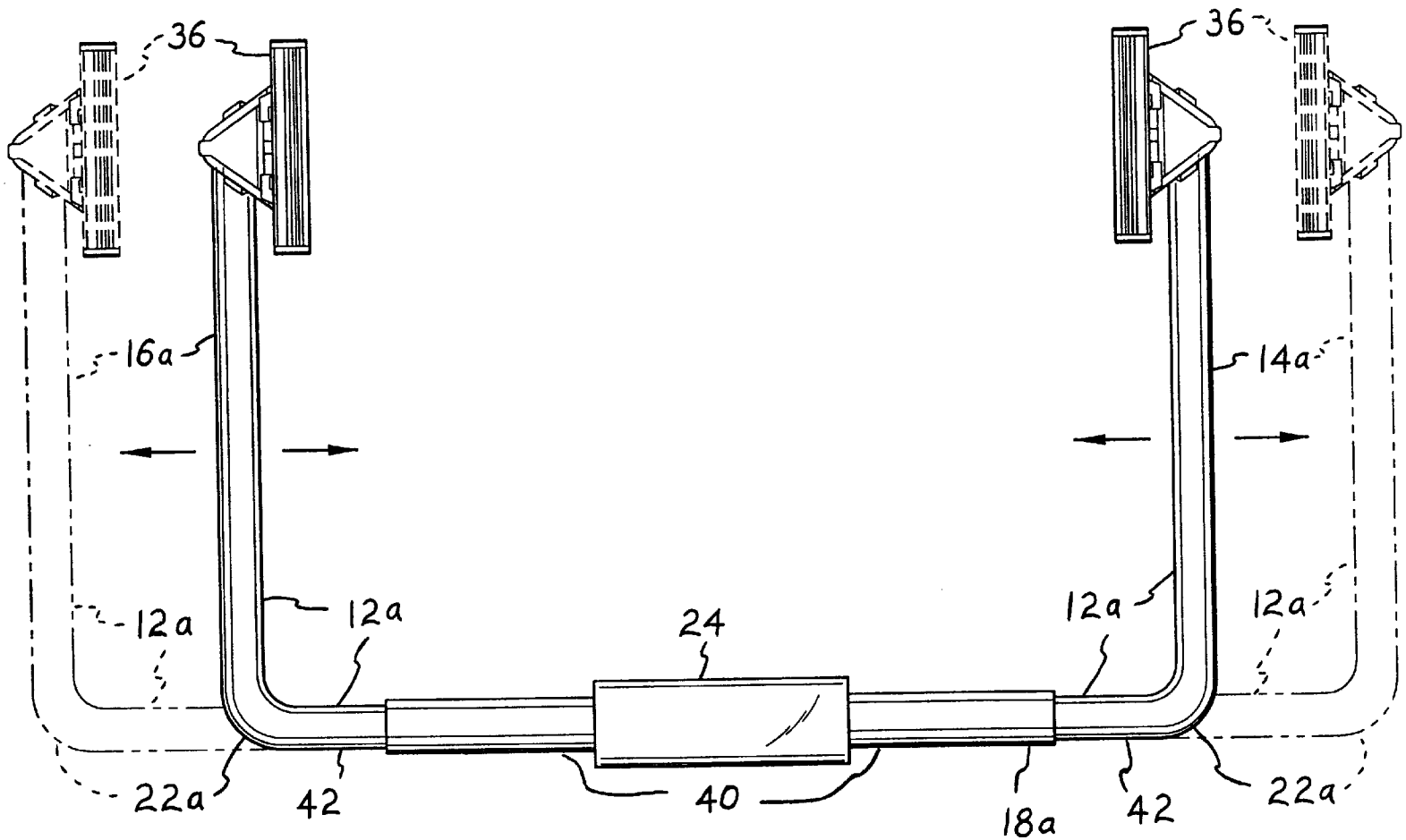
FIG. 4 is a top plan view of an alternative embodiment of the present invention, showing means for adjusting the width.
Figure 5:
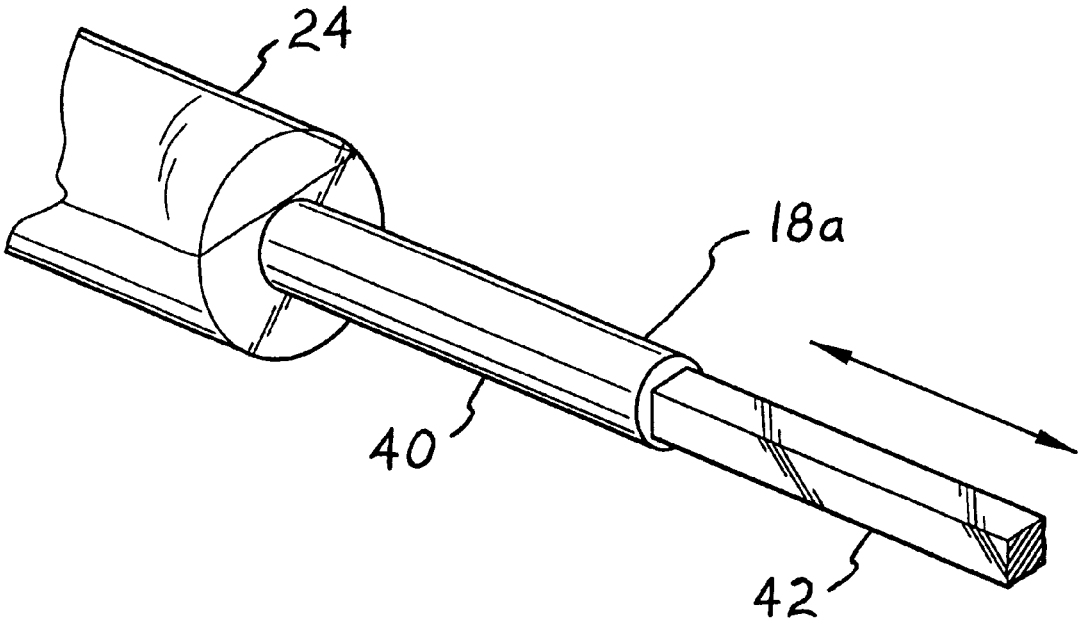
FIG. 5 is a broken away detailed perspective view of the adjustment means of FIG. 4.

FIGS. 4 and 5 illustrate an alternative means for providing lateral adjustment of the width between the sideburn trimming elements 36, for use when relatively non-flexible materials are used for the construction of the handle portion of the device. The dual sideburn trimming device **10*a* of FIG. 4 also provides the advantage of maintaining a set distance between the two trimming elements or heads 36 once the distance has been set, rather than springing back to e. g. a wider setting when pressure is removed, as shown in FIG. 4, due to the natural spring tendency of the handle 12** material.

The sideburn trimmer **10*a* of FIG. 4 is configured generally like the device 10 of FIGS. 1 through 3, having a handle portion 12*a* with two parallel, opposed arms, respectively 14*a* and 16*a*. A telescoping crossmember 18*a* joins the two arms 14*a* and 16*a* at their crossmember attachment ends, respectively 20*a* and 22*a*. The crossmember attachment ends or junctures 20*a* and 22*a* with the crossmember 18*a* may be smoothly curved; alternatively, the entire crossmember portion 18 may be smoothly curved between the two opposed arms 14 and 16, if so desired, although the construction of such a curved and telescoping crossmember is somewhat more difficult and costly than forming the crossmember 18*a* of straight members. Also, while telescoping members are shown disposed to each side of the centrally positioned level means 24 in FIG. 4, it will be understood that the trimmer 10***a* may be constructed to have only one side of the crossmember 18*a* with telescoping adjustment means, if so desired.

The crossmember 18*a* of the sideburn trimming device 10*a* of FIG. 4 includes a central section 40, which includes the leveling means 24 installed therein or thereon. The central section 40 (or each section to either side of the leveling means 24) is formed of a hollow tube, to provide for the telescoping insertion of corresponding outer portions 42 of the crossmember 18*a* therein.

The hollow interior of the central section 40 and the outer portions 42 of the crossmember 18*a* are formed having substantially identical, non-circular cross sections (e. g., the square cross section shown in FIG. 5), in order to preclude axial rotation of the outer portions 42 within the central portions 40 of the crossmember 18*a*, and thus assure that the two arms 14*a* and 16*a* remain parallel to one another. Thus, the user of the laterally adjustable sideburn trimmer 10*a* of FIG. 4 may telescope the two outer portions 42 of the crossmember 18 inwardly, as shown in solid lines in FIG. 4, or may telescope the outer members 42 outwardly, as shown in broken lines in FIG. 4, as desired to position the two cutting or trimming elements 36 precisely against the sideburns for accurate trimming.

In summary, the present dual sideburn trimmer in its various embodiments provides a novel means for quickly, easily, and evenly trimming the sideburns of a user of the device. The present trimming device not only includes two spaced apart cutting or trimming elements for simultaneous sideburn trimming on opposite sides of the user's head, but also includes leveling means, neither of which features are a part of any trimming or measuring devices of the related art. The means for adjusting the lateral width or distance between the two cutting or trimming elements provides further accuracy for the user. With a device having a flexible frame or handle portion, the user need only apply slight pressure as required to both of the arms to space the trimming elements at the proper distance apart for trimming the sideburns. The provision of a telescoping crossmember portion enables the user to set the distance between the two trimming elements as desired, with the device then maintaining that setting until readjusted. The economy of the present dual sideburn trimmer, with its disposable blade elements, will find favor with those who have hair styles which require the neat and accurate trimming of the sideburns on a regular basis.

It is to be understood that the present invention is not limited to the embodiments described above, but encompasses any and all embodiments within the scope of the following claims.

I claim:

1. A dual sideburn trimmer comprising:

a handle comprising two parallel, opposed arms;

each of said arms having a crossmember attachment end, an opposite trimming element attachment end, and a crossmember extending between said crossmember attachment end of each of said arms;

a sideburn trimming element disposed at said trimming element attachment end of each of said arms; and leveling means disposed along said crossmember of said handle, for laterally leveling said handle and each said sideburn trimming element.

2. The dual sideburn trimmer as defined by claim 1, wherein said leveling means is a spirit level comprising a level fluid encapsulated within a level vial, with said vial including a level line disposed thereon.

3. The dual sideburn trimmer as defined by claim 2, wherein said level fluid is water.

4. The dual sideburn trimmer as defined by claim 2, wherein said level fluid is tinted for good visibility thereof.

5. The dual sideburn trimmer as defined by claim 1, including lateral width adjustment means for adjusting the distance between each said sideburn trimming element.

6. The dual sideburn trimmer as defined by claim 5, wherein said lateral width adjustment means comprises each of said arms being formed of flexible material.

7. The dual sideburn trimmer as defined by claim 5, wherein said lateral width adjustment means comprises telescoping means for at least one of said arms relative to said crossmember.

8. The dual sideburn trimmer as defined by claim 1, wherein said handle portion is formed of materials selected from the group consisting of plastics and metals.

9. The sideburn trimmer as defined by claim 1, wherein each said sideburn trimming element comprises a disposable shaving razor cartridge and said trimming element attachment end of each of said arms further includes means for removably receiving and holding said disposable shaving razor cartridge.

10. A dual sideburn trimmer comprising:

a generally U-shaped handle;

said handle including two opposed trimming element attachment ends;

a sideburn trimming element disposed at each of said trimming element attachment ends; and leveling means disposed within said handle for leveling each of said trimming element attachment ends of said handle and each said sideburn trimming element relative to one another.

11. The dual sideburn trimmer as defined by claim 10, wherein said handle comprises two parallel, opposed arms, with each of said arms having a crossmember attachment end and an opposite trimming element attachment end, and a crossmember extending between said attachment end of each of said arms.

12. The dual sideburn trimmer as defined by claim 11, including lateral width adjustment means for adjusting the distance between each said sideburn trimming element.

13. The dual sideburn trimmer as defined by claim 12, wherein said lateral width adjustment means comprises telescoping means for at least one of said arms relative to said crossmember.

14. The dual sideburn trimmer as defined by claim 12, wherein said lateral width adjustment means comprises said handle being formed of flexible material.

15. The dual sideburn trimmer as defined by claim 10, wherein said leveling means is a spirit level comprising a level fluid encapsulated within a level vial, with said vial including a level line disposed thereon.

16. The dual sideburn trimmer as defined by claim 15, wherein said level fluid is water.

17. The dual sideburn trimmer as defined by claim 15, wherein said level fluid is tinted for good visibility thereof.

18. The dual sideburn trimmer as defined by claim 10, wherein said handle portion is formed of materials selected from the group consisting of plastics and metals.

19. The sideburn trimmer as defined by claim 10, wherein each said sideburn trimming element comprises a disposable shaving razor cartridge and said trimming element attachment ends of said handle each further include means for removably receiving and holding said disposable shaving razor cartridge.

* * * * *